US010230175B2

(12) United States Patent
John et al.

(10) Patent No.: US 10,230,175 B2
(45) Date of Patent: Mar. 12, 2019

(54) ANTENNA RADIATION ELEMENT AND MULTIBAND ANTENNA

(71) Applicant: KMW Inc., Hwaseong, Gyeonggi-do (KR)

(72) Inventors: Stewart Wilson John, Huntington Beach, CA (US); Soon-Wook Kim, Gyeonggi-do (KR); Jae-Hwan Lim, Seoul (KR); Seong-Ha Lee, Incheon (KR); Seung-Hwa Kim, Gyeonggi-do (KR); Jae-Ho Han, Incheon (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 39 days.

(21) Appl. No.: 15/143,888

(22) Filed: May 2, 2016

(65) Prior Publication Data

US 2016/0248171 A1 Aug. 25, 2016

Related U.S. Application Data

(63) Continuation of application No. PCT/KR2014/009827, filed on Oct. 20, 2014.

(30) Foreign Application Priority Data

Nov. 5, 2013 (KR) ..... 10-2013-0133571

(51) Int. Cl.
*H01Q 21/00* (2006.01)
*H01Q 21/26* (2006.01)
(Continued)

(52) U.S. Cl.
CPC ..... *H01Q 21/26* (2013.01); *H01Q 1/246* (2013.01); *H01Q 1/48* (2013.01); *H01Q 5/40* (2015.01);
(Continued)

(58) Field of Classification Search
CPC ..... H01Q 21/26; H01Q 19/12; H01Q 1/48; H01Q 1/24; H01Q 19/10
(Continued)

(56) References Cited

U.S. PATENT DOCUMENTS

2004/0140942 A1* 7/2004 Gottl ..... H01Q 13/10 343/810
2006/0114168 A1 6/2006 Gottl et al.
(Continued)

FOREIGN PATENT DOCUMENTS

DE 10 2007 060 083 A1 6/2009
DE 10 2014 014 434 A1 3/2016
(Continued)

OTHER PUBLICATIONS

Supplementary European Search Report dated Jun. 16, 2017 in corresponding European Patent Application No. 14859690.1.
(Continued)

*Primary Examiner* — Hai Tran
(74) *Attorney, Agent, or Firm* — Mintz Levin Cohn Ferris Glovsky and Popeo, P.C.; Kongsik Kim

(57) ABSTRACT

The present invention relates to a multiband antenna comprising: a reflector providing a ground plane; a first radiation module for a first frequency band, provided on the reflector; and a plurality of second radiation modules for a second frequency band, laminated on the first radiation module, wherein: the first radiation module includes first to fourth radiation elements symmetrically combined in four directions on an entire plane, wherein each of the first to fourth radiation elements includes a radiation arm in a cup shape and a support for supporting and fixing the radiation arm to the reflector, and the second radiation modules are provided to each radiation arm of the first to fourth radiation elements, wherein the lower surface of the cup shape of each radiation
(Continued)

110: 110a, 110b
120: 120a, 120b arm of the first to fourth radiation elements is designed to have a predetermined area for providing the ground plane to the second radiation modules.

6 Claims, 7 Drawing Sheets

(51) Int. Cl.

| | |
|---|---|
| ***H01Q 1/48*** | (2006.01) |
| ***H01Q 19/12*** | (2006.01) |
| ***H01Q 1/24*** | (2006.01) |
| ***H01Q 21/06*** | (2006.01) |
| ***H01Q 21/24*** | (2006.01) |
| ***H01Q 5/40*** | (2015.01) |

(52) U.S. Cl.
CPC ..... *H01Q 19/12* (2013.01); *H01Q 21/062* (2013.01); *H01Q 21/24* (2013.01)

(58) Field of Classification Search
USPC ..... 343/797, 795, 810
See application file for complete search history.

(56) References Cited

U.S. PATENT DOCUMENTS

| | | | | |
|---|---|---|---|---|
| 2012/0112977 | A1 | 5/2012 | Yun | |
| 2012/0133567 | A1 | 5/2012 | Harel et al. | |
| 2012/0146871 | A1* | 6/2012 | Choi ..... | H01Q 21/26 343/795 |

FOREIGN PATENT DOCUMENTS

| | | | |
|---|---|---|---|
| JP | 2002-043838 | A | 2/2002 |
| JP | 2005-516513 | A | 6/2005 |
| JP | 2012-529827 | A | 11/2012 |
| JP | 2013-503550 | A | 1/2013 |
| KR | 10-2007-0083723 | A | 8/2007 |
| KR | 10-2010-0033888 | A | 3/2010 |
| KR | 10-0987367 | B1 | 10/2010 |
| KR | 10-2012-0088471 | A | 8/2012 |

OTHER PUBLICATIONS

Office Action dated Jun 19, 2017 in corresponding Japanese Patent Application No. JP 2016-527436.
Examination Report dated Mar. 6, 2017 in corresponding Japanese Patent Application No. JP 2016-527436.

* cited by examiner

10: 11, 12, 13, 14
20: 20-1, 20-2, 20-3, 20-4

ANTENNA RADIATION ELEMENT AND MULTIBAND ANTENNA

CROSS REFERENCE TO RELATED APPLICATIONS

This application is a continuation of International Application No. PCT/KR2014/009827 filed on Oct. 20, 2014, which claims priority to Korean Application No. 10-2013-0133571 filed on Nov. 5, 2013, which applications are incorporated herein by reference.

TECHNICAL FIELD

The present invention relates to an antenna technology suitable for being used in a mobile communication (PCS, Cellular, IMT-2000, etc.) base station or a relay and, in particular, to an antenna radiation element suitable for implementing a dual polarized antenna and a multiband antenna using the same.

BACKGROUND ART

At present, according to the universalization of mobile communication and activation of wireless broadband data communication, various frequency bands are used as available frequency bands in order to sufficiently ensure frequency band which is insufficient. The mainly used frequency bands are a low frequency band (698-960 MHz) and a high frequency band (1.71-2.17 GHz or 2.3-2.7 GHz). In addition, a multiple input multiple output (MIMO) technology based on a multiband antenna is an essential technology for increasing data transmission speed and is being applied to recent mobile communication network systems such as long term evolution (LTE) and Mobile WiMAX.

However, to install a plurality of antennas in order to support MIMO in the various frequency bands causes limitations in terms of tower space in which an antenna is installed in real outside environment as well as an increase in installation costs. Thus, a multiband antenna such as a dual band antenna or a triple band antenna is necessarily required. The multiband antenna has a structure in which a high frequency band antenna is inserted in the same space as that used for installing a low frequency band antenna, while maximally reducing an interference effect between elements, so as to maximally efficiently design an antenna area, especially, the width of the antenna. An example of such a multiband antenna is the earlier application by the present applicant in Korean Patent Publication No. 10-2010-0033888 (Title: "Dual band dual polarized antenna for a mobile communication base station", inventors: Youngchan MOON, Ohseok CHOI, Published: described in the Mar. 31, 2010).

Generally, a multiband antenna, as described in Patent Publication NO. 10-2010-0033888, has a structure in which first radiation modules of a low frequency band and second and/or third radiation modules of a high frequency band are properly placed on at least one reflector erected in the lengthwise direction. For example, the first radiation modules may be vertically arranged in a row, and the second and/or third radiation modules may be vertically arranged on the left and right sides of the first radiation elements in a row, respectively. At this time, generally, each of the first radiation modules, the second radiation modules, and third radiation modules is combined in four directions of four radiation elements and, overall, is arranged with an angle of +45 and −45 degrees with respect to verticality (or horizontality), thereby generating two linearly polarized wave which are orthogonal.

Meanwhile, recently, as a radiation element and radiation module having a broadband characteristic have been required, a radiation element including a band where about 45 percent of the band is a fractional band width has been provided. The radiation element, for example, may have an operation characteristic of 1710-2690 MHz bands. In case of implementing the multiband antenna using a broadband radiation element, an interference problem between elements of each band is seriously on the rise, thus, this problem causes difficulty which is insurmountable at the time of efficiently designing a multiband antenna.

SUMMARY

Accordingly, an aspect of the present invention is to provide an antenna radiation element and a multiband antenna having a more optimized structure, convenience of antenna design by enabling the optimization of an antenna size, and a more stable characteristic.

Another aspect of the present invention is to provide an antenna radiation element and a multiband antenna, which can reduce the interference between the radiation elements, make the width of the antenna narrower, and easily implement a multiband antenna within a limited width.

To achieve the aspects, according to a standpoint of the present invention, a multiband antenna includes: a reflector providing a ground plane; a first radiation module for a first frequency band installed on the reflector; and a second radiation module for a second frequency band installed to be laminated on the first radiation module, wherein: the first radiation module includes first to fourth radiation elements symmetrically combined in four directions on an entire plane, wherein each of the first to fourth radiation elements includes a cup-shaped radiation arm and a support for supporting and fixing the radiation arm to the reflector, and the second radiation modules are installed to each radiation arm of the first to fourth radiation elements, wherein the lower surface of the cup shape of each radiation arm of the first to fourth radiation elements is designed to have a predetermined area for providing the ground plane to the second radiation modules which are installed on the upper side.

According to another standpoint of the present invention, an antenna radiation element includes a cup-shaped radiation arm and a support for supporting and fixing the radiation arm on the reflector of the antenna.

In the above, each of the cup-shaped radiation arms of the radiation element has a stepped cup shape in which an upper portion is wide and a lower portion is narrow, and is an overall square-shaped cup.

DETAILED DESCRIPTION

Hereinafter, an exemplary embodiment according to the present invention will be described in detail with reference to the accompanying drawings. Various specific definitions found in the following description are provided only to help general understanding of the present invention, and it is apparent to those skilled in the art that the present invention can be implemented without such definitions.

Figure 1:
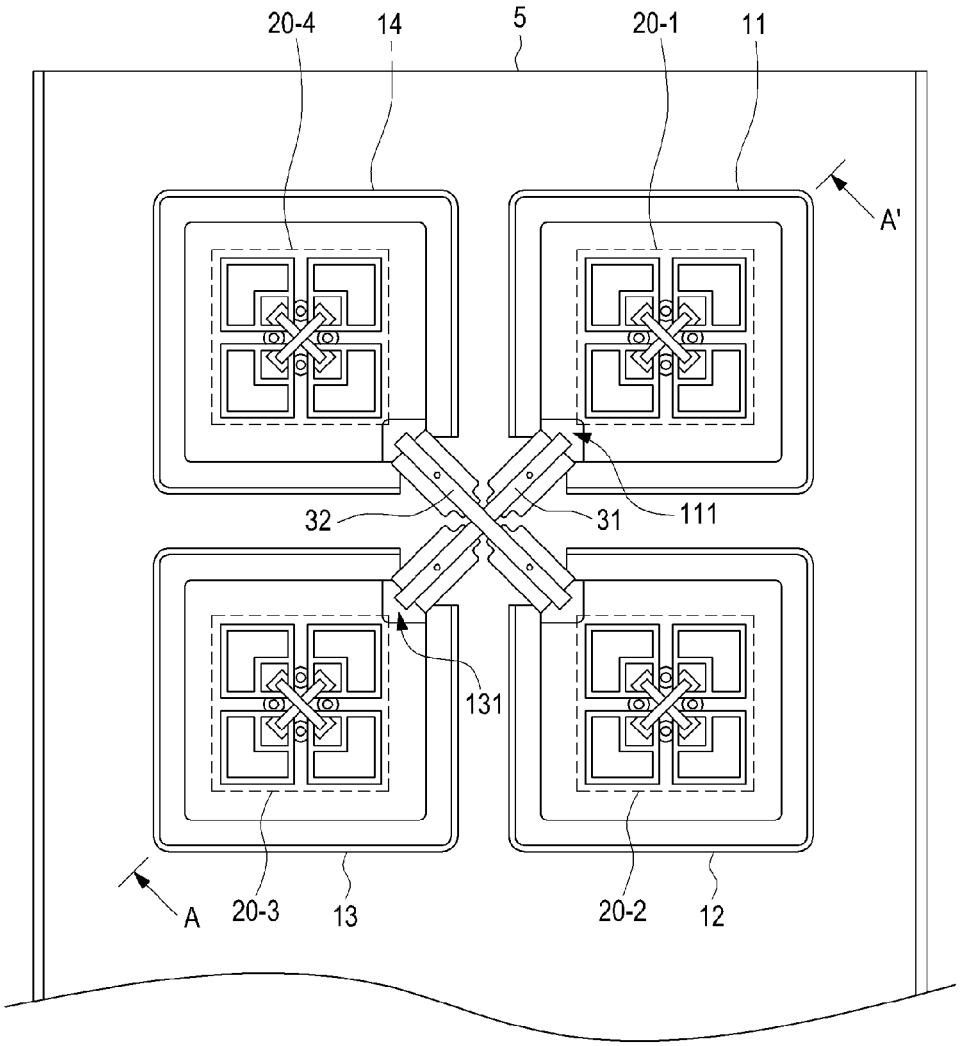
FIG. 1 is a planar structure of an antenna radiation element and a multiband antenna according to an embodiment of the present invention.
Figure 2:
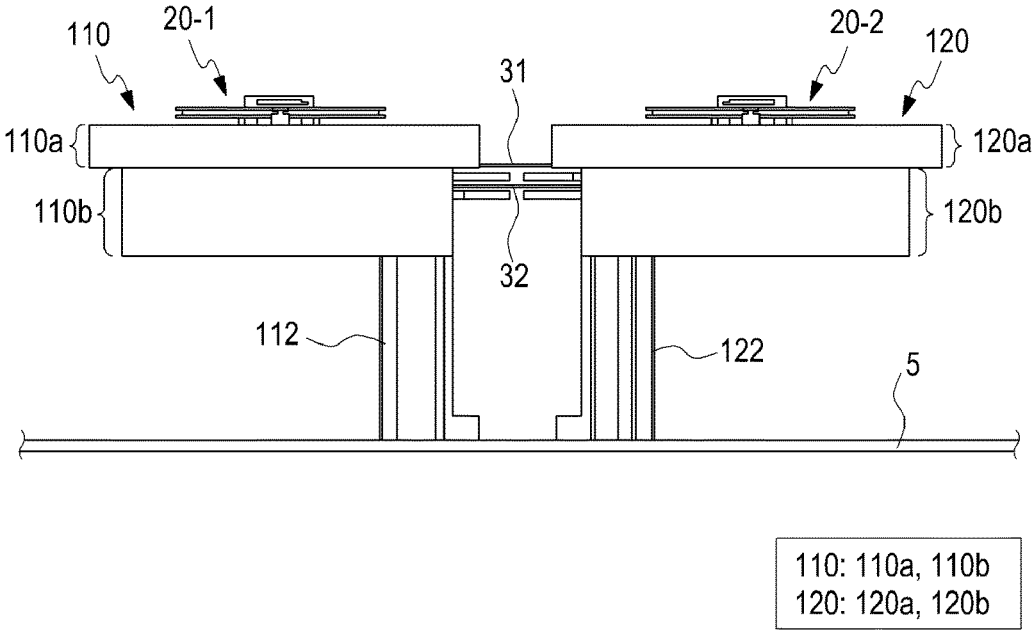
FIG. 2 is a side view of FIG. 1.
Figure 3:
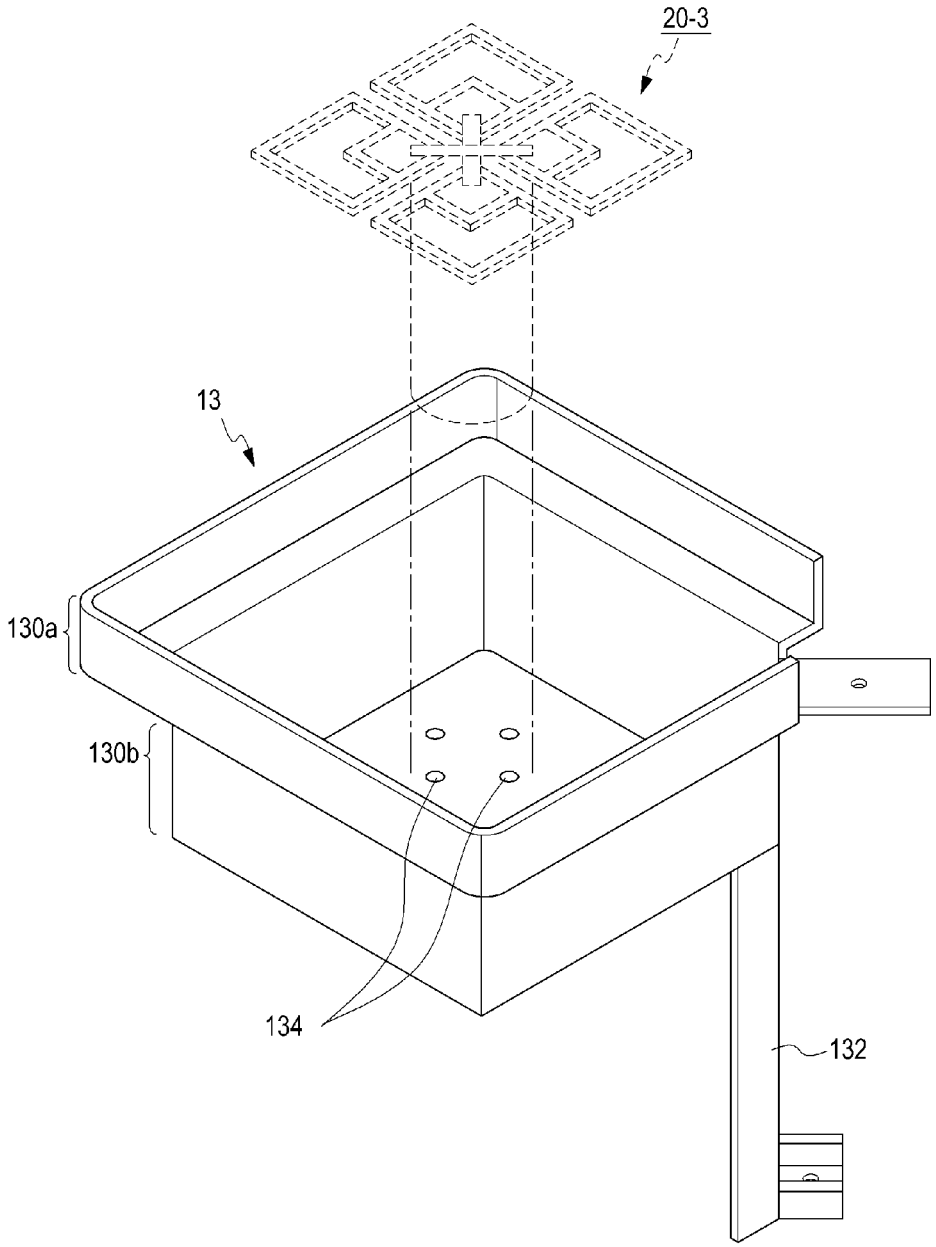
FIG. 3 is a perspective view of one radiation element of first radiation modules of FIG. 1.
Figure 4:
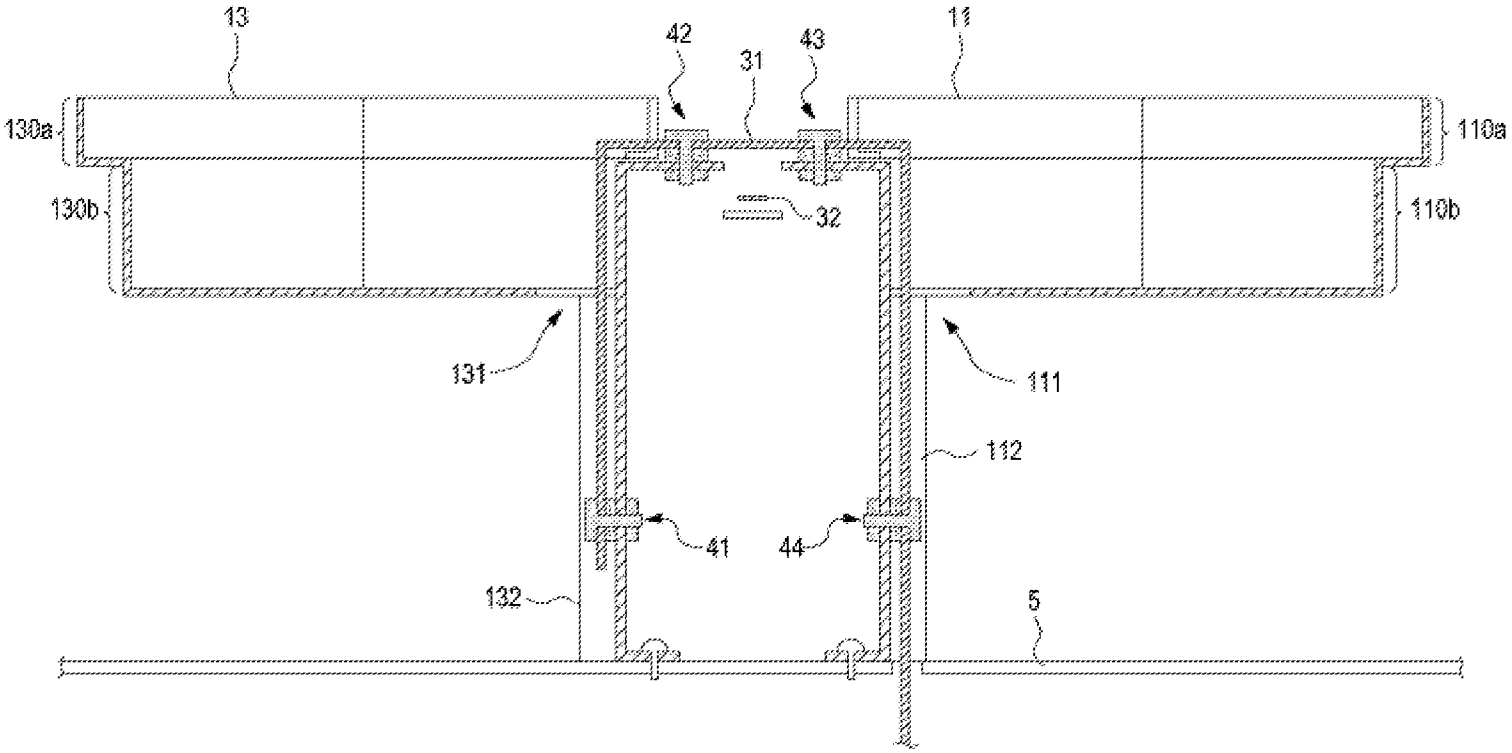
FIG. 4 is a section view of A-A' part of the first radiation module of FIG. 1.
Figure 5:
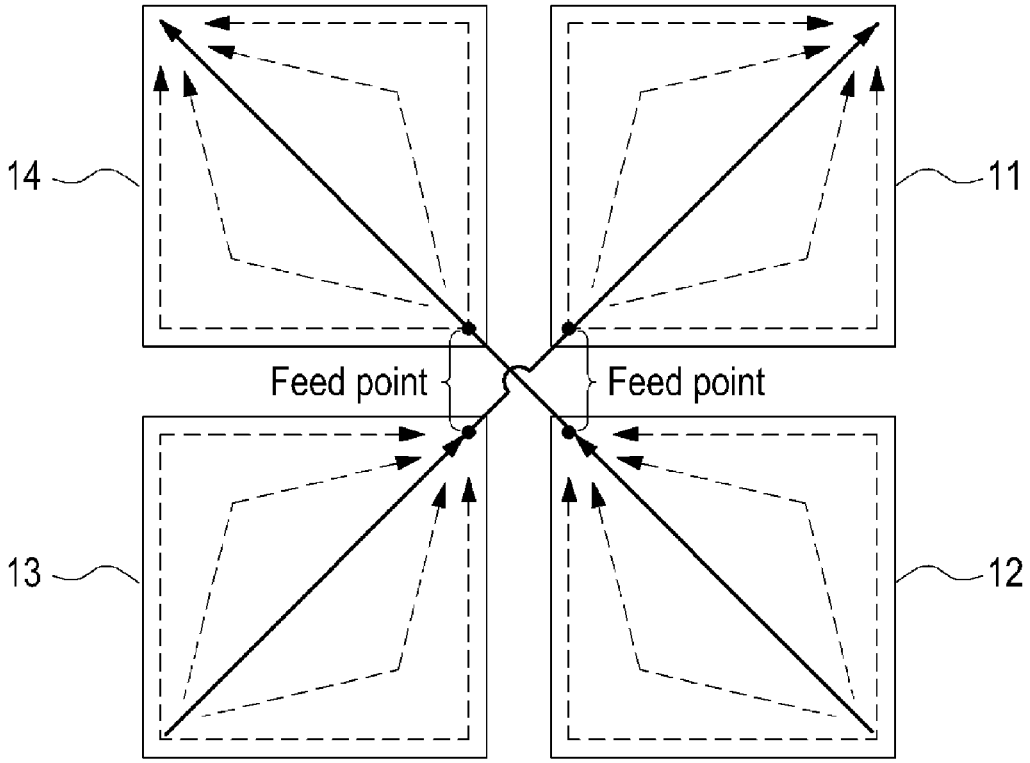
FIG. 5 is a schematic diagram indicating a generation state of an X polarized wave by the first radiation module of FIG. 1.

FIG. 1 is a planar structure view of an antenna radiation element and a multiband antenna according to an embodiment of the present invention, FIG. 2 is a side view of FIG. 1, FIG. 3 is a perspective view of one radiation element (for example, a third radiation element) of first radiation module of FIG. 1, FIG. 4 is a section view of A-A' part of the first radiation module of FIG. 1, and FIG. 5 is a schematic diagram indicating a generation state of an X polarized wave of the first radiation module of FIG. 1. FIG. 1 to FIG. 5 illustrate, as an example, a multimode antenna having a structure in which one first radiation module 10: 11, 12, 13, and 14 is installed on one reflector 5 and four second radiation modules 20-1, 20-2, 20-3, and 20-4 are installed on the first radiation module 10.

Referring to FIG. 1 to FIG. 5, a multimode antenna according to an embodiment of the present invention basically includes a first radiation module 10 for a first frequency band (for example, 698-960 MHz bands) which is installed on a reflector 5 that functions as a ground plane. The first radiation module 10 is configured by symmetrically combining first to fourth radiation elements 11, 12, 13, and 14 in four directions on an entire plane, each of the first to fourth radiation elements 11, 12, 13, and 14 is configured to include cup-shaped radiation arms 110, 120, 130, etc. and supports 112, 122, 132, etc. for supporting the radiation arms. The first to fourth radiation elements 11, 12, 13, and 14 may all have the same structure, just different directions and positions of an arrangement.

More specifically, the radiation arms 110: 110*a* and 110*b* of the first radiation element 11 may have a stepped cup shape in which an upper portion 110*a* is wide and a lower portion 110*b* is narrow and an overall cup shape may be a square. The support 112 for supporting the first radiation elements 11 which is installed to be spaced apart from each other on the reflector 5 is configured to be fixed on the reflector 5 by integrally extending with a radiation arm 110 at a position corresponding to the center side in an installation area of the entire first radiation module 10. At this time, the support 112 may be fixedly attached to the reflector 5 by a welding or screw-coupling way.

The radiation arms 120, 130, etc. of the second to fourth radiation element 12, 13, and 14 and the supports 122, 132, etc. are similarly configured. For example, the first to fourth radiation arms 11, 12, 13, and 14 sequentially form a partial structure corresponding to the upper right part, lower right part, lower left part, and upper left part, respectively, in an entire form of the first radiation module 10.

Meanwhile, as illustrated more clearly in FIG. 4, referring to a feed structure of the first radiation module 10 configured in this way, a first feed line 31 having a strip line structure is installed to be supported by the supports 112 and 132 of the first and third radiation elements 11 and 13 to transfer a signal with the radiation arms 110 and 130 of the first and third radiation elements 11 and 13 in a non-contact coupling manner and a second feed line 32 is installed to be supported by the support 122, etc. of the second and fourth radiation elements 12 and 14 to transfer a signal in a non-contact coupling manner with radiation arms 120, etc. of the second and fourth radiation elements 12 and 14. As each support 112, 122, 132, etc. electrically functions as a ground terminal for the strip line, the length of each support is designed according to $\lambda/4$ of wavelength of a corresponding process signal to be in an open state (a ground state).

In this case, a parallel plane which is opposed to the strip lines of the first and second feed lines 31 and 32 and is configured to maintain a predetermined distance is formed on a central longitudinal axis of each support 112, 122, 132, etc., and spacers 41, 42, 43, and 44, which have a proper structure for supporting the relevant feed line and maintaining a space between the relevant feed line and the relevant support to be spaced consistently, may be installed at predetermined position between the parallel plane of each support 112, 122, 132, etc. and the strip lines of the first and second feed lines 31 and 32.

Since the feed structure is provided, as described in FIG. 5, the radiation arm 110 of the first radiation element 11 and the radiation arm 130 of the third radiation element 13 form a polarized wave of +45 degree compared to a vertical axis, the radiation arms 120, etc. of the second and fourth radiation elements 12 and 14 form a polarized wave of −45 degree, in an 'X'-shaped polarized wave of an entire first radiation module 10.

As described above, in the first radiation module 10 configured by the first to fourth radiation elements 11-14, according to an embodiment of the present invention, second radiation modules 20-1, 20-2, 20-3, and 20-4 for generating an X polarized wave for a first frequency band (for example, a broadband of 1710-2690 MHz bands) are respectively installed in each of the radiation arms 110, 120, 130, etc. of the first to fourth radiation elements 11-14. Each of the second radiation modules 20-1, 20-2, 20-3, and 20-4 may be implemented by intactly adopting conventional radiation elements provided in various structures such as dipole type.

In FIG. 3, for example, an example of installing the second radiation module 20-3 on the center portion of the lower surface of the cup-shaped radiation arm 130 of the second radiation element 13 is described. At this time, it is described that the corresponding second radiation module to be installed 20-3 is fixed and installed by screw-coupling and the like in the lower surface of the radiation arm 130. Also, a plurality of screw holes 134 for installing a feed line of the second radiation module 20-3 is formed.

At this time, it is a very important feature that each of the radiation arms 110, 120, 130, etc. of the first to fourth radiation elements 11-14 has a cup shape. More specifically, primarily, a sufficient ground plane is provided on the second radiation modules 20-1, 20-2, 20-3, and 20-4 in which a lower surface of a large area of a cup shape is installed on an upper side. In order to reduce the entire size of an antenna, when it is possible to consider laminating and installing the second radiation module on an upper portion of the first radiation module, a problem of real implementation is that a sufficient ground characteristic cannot be provided to the second radiation module. The symmetry of the ground plane of the radiation element is a very important factor in a radiation pattern characteristic, the present invention solves such a problem through each cup-shaped radiation element of the first radiation module as described above.

In addition, cup-shaped sides of each of the radiation arms 110, 120, 130, etc. of the first to fourth radiation elements 11-14 serve to remove (or reduce) an effect of the first radiation module 10 with respect to the second radiation modules 20-1, 20-2, 20-3, and 20-4 which are installed on each of the radiation arms 110, 120, 130, etc., thus, it helps make the radiation characteristic of the second radiation modules 20-1, 20-2, 20-3, and 20-4 stable and make the beam width of a radiation pattern symmetrical.

In addition, each of the radiation arms 110, 120, 130, etc. of the first to fourth radiation elements 11-14 may have a simple shape but, in the present embodiment, each of the radiation arms 110, 120, 130, etc. of the first to fourth radiation elements 11-14 has a stepped cup shape in which upper portions 110*a*, 120*a*, 130*a*, etc. are wide and lower portions 110*b*, 120*b*, and 130*b* are narrow. As it is implemented to form a radiation pattern optimized according to a radiation characteristic of the first radiation module 10 and the second radiation module 20, for example, cup-shaped lower portions 110*b*, 120*b*, 130*b*, etc. are designed by considering a space with the second radiation module 20 to optimize a radiation characteristic of the second radiation modules 20-1, 20-2, 20-3, and 20-4 which are installed inside, cup-shaped upper portions 110*a*, 120*a*, 130*a*, etc. are designed by considering a space with (an radiation arm of) another first radiation module which is installed around.

Thus, it is possible to have a structure in which the second radiation module 20 is laminated to the first radiation module 10 of the present invention, in terms of the laminated structure, the radiation elements of the first radiation module which is in a relatively lower frequency band function as a radiation element of the first frequency band and a ground of the second radiation module at the same time. That is, the radiation elements of the first radiation module function as a reflector of the second radiation module.

By having the configuration as described above, it is possible to reduce interaction between bands which is a problem in a prior art.

Figure 6A:
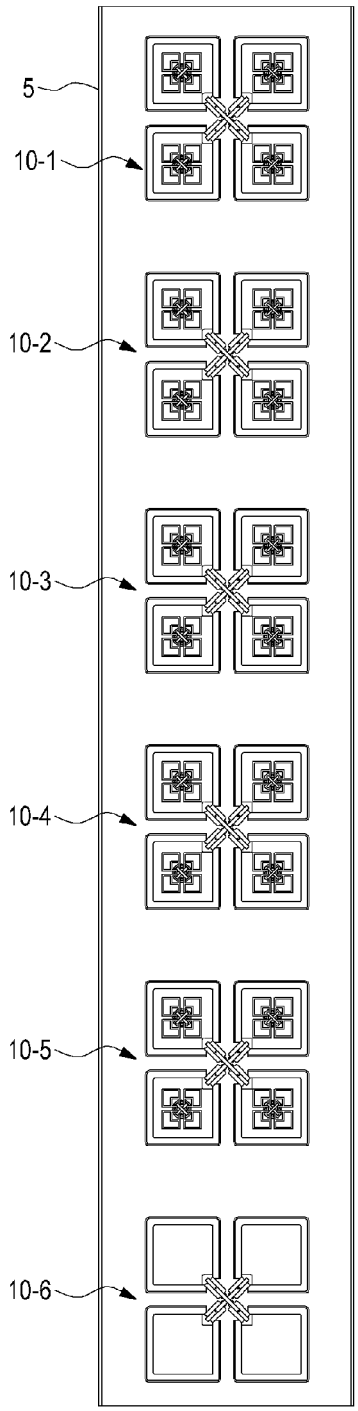
FIG. 6A and FIG. 6B are planar structure views of a multiband antenna according to other embodiments of the present invention.
Figure 6B:
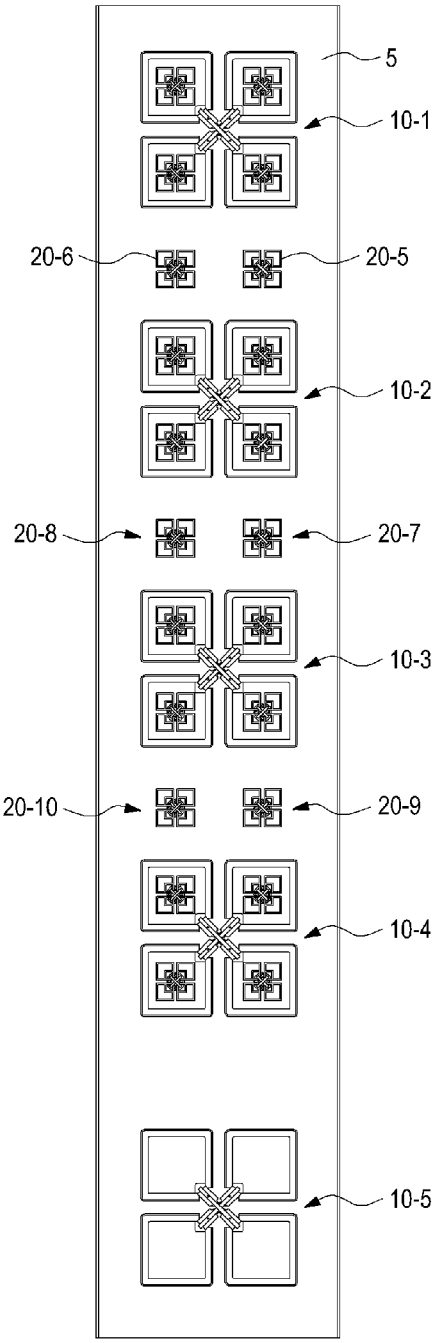

FIG. 6A and FIG. 6B are planar structure views of a multiband antenna according to other embodiments of the present invention. First, referring to a structure illustrated in FIG. 6A, FIG. 6B illustrates that a structure in which the first radiation modules 10-1, 10-2, 10-3, 10-4, 10-5, etc. on which a plurality of the second radiation modules is laminated, which may have the same structure as the structure illustrated in FIG. 1 to FIG. 5, are vertically placed on the reflector 5 with a proper space between them. In this case, the space between the first radiation modules is properly configured by generally considering a radiation characteristic of the relevant first radiation module and a radiation characteristic of the second radiation module.

Referring to a structure illustrated in FIG. 6B, FIG. 6B illustrates that a structure in which the first radiation modules 10-1, 10-2, 10-3, 10-4, 10-5, etc. on which a plurality of the second radiation modules is laminated, which may have the same structure as the structure illustrated in FIG. 1 to FIG. 5, are vertically placed on the reflector 5 with a proper space between them. In addition, FIG. 6B illustrates that a structure in which the second radiation modules 20-5, 20-6, 20-7, 20-8, 20-9, and 20-10 which are directly installed on the reflector 5 is additionally installed between at least a part of the first radiation modules 10-1, 10-2, 10-3, 10-4, and 10-5. Of course, in this case, a space between the first radiation modules is properly configured by considering an entire radiation characteristic of the first radiation modules and the second radiation modules.

An antenna radiation element according to an embodiment of the present invention as described above and a multiband antenna configuration and operation using the same may be performed. Meanwhile, specific embodiments according to the present invention have been described above, but various modifications may be performed without departing from the scope of the present invention.

For example, the above description shows that a plurality of the first radiation modules according to an embodiment of the present invention is vertically placed on one reflector in a row, however, a plurality of the first radiation modules may be vertically placed in two or more rows in another embodiment of the present invention. Of course, in this case, the second radiation module may be installed to be laminated on all or at least a part of first radiation modules.

Furthermore, in the above description, the example in which the second radiation module is always laminated to the first radiation module is described, but as indicated by a reference numeral 10-6 in FIG. 6A and a reference numeral 10-5 in FIG. 6B, it is possible to separately install the first radiation module without laminating of the second radiation module.

In addition to that, various modifications and variations can be made without departing from the scope of the present disclosure, and the scope of the present disclosure shall not be determined by the above-described embodiments and has to be determined by the following claims and equivalents thereof.

As described above, a radiation element and a multiband antenna according to the present invention can have a more optimized structure, convenience of antenna design by enabling the optimization of the antenna size, and a more stable characteristic. In particular, the radiation element and multiband antenna can reduce the interference between the radiation elements, make the width of the antenna narrower, and easy implement a multiband antenna within a limited width.

What is claimed is:

1. A radiation module generating a dual polarization comprising:

four radiation elements symmetrically combined in four directions, wherein each of the four radiation elements includes a cup-shaped radiation arm; and a support for supporting and fixing the cup-shaped radiation arm on a reflector of an antenna, and the cup-shaped radiation arms of the four radiation elements are combined with each other to generate the dual polarization of the radiation module, wherein each of the cup-shaped radiation arms of the four radiation elements includes a lower surface and side surfaces completely enclosing the lower surface.

2. The radiation module of claim 1, wherein each of the cup-shaped radiation arms is stepped cup shape in which an upper portion is wide and a lower position is narrow, and overall, each of the cup-shaped radiation arms is a square-shaped cup.

3. A multiband antenna comprising:

a reflector providing a first ground plane;

a first radiation module for generating a dual polarization or a first frequency band installed on the reflector;

a plurality of second radiation modules for generating a dual polarization of a second frequency band, installed to be laminated on the first radiation module, wherein the first radiation module comprises first, second, third and fourth radiation elements symmetrically combined in four directions, wherein each of the first to fourth radiation elements includes a cup-shaped radiation arm and a support for supporting and fixing the radiation arm to the reflector, wherein the plurality of the second radiation modules are respectively installed in each radiation arm of the first to the fourth radiation elements, wherein a lower surface of the cup shape of each radiation arm of the first to fourth radiation elements is designed to have a predetermined area for providing a second ground plane to each of the plurality of the second radiation modules, wherein the radiation arms of the first and third radiation elements combine with one another to generate a first polarized wave of the dual polarization of the first radiation module, and the radiation arms of the second and fourth radiation elements combine with one another to generate a second polarized wave of the dual polarization of the first radiation module, wherein each of the cup-shaped radiation arms of the first to the fourth radiation elements includes a lower surface and side surfaces completely enclosing the lower surface.

4. The multi band antenna of claim 3, wherein each of the cup-shaped radiation arms of the first to the fourth radiation elements is a stepped cup shape in which an upper portion is wide and a lower portion is narrow, and overall, each of the cup-shaped radiation arms is a square-shaped cup.

5. The multiband antenna of claim 3, wherein a plurality of the first radiation modules laminated the plurality of second radiation modules are vertically placed on the reflector.

6. The multiband antenna of claim 5, wherein a third radiation module for the second frequency band is additionally installed on the reflector between the plurality of the placed first radiation modules.

* * * * *